US005419486A

United States Patent [19]

Bennett et al.

[11] Patent Number: 5,419,486

[45] Date of Patent: May 30, 1995

[54] MULTI-SIDED CONTAINER

[75] Inventors: Darrell K. Bennett; Robert G. Tomich, both of Concord, N.H.

[73] Assignee: Universal Packaging Corporation, Concord, N.H.

[21] Appl. No.: 90,775

[22] Filed: Jul. 13, 1993

[51] Int. Cl.[6] ..... B65D 5/24

[52] U.S. Cl. ..... 229/109; 229/120.17; 229/186; 229/903; 229/906; 493/121; 493/133; 493/162

[58] Field of Search ..... 229/109, 110, 120.17, 229/223, 224, 228, 240, 243, 902, 903, 906, 186; 493/121, 133–135, 141–146, 162, 177–182

[56] References Cited

U.S. PATENT DOCUMENTS

| | | | |
|---|---|---|---|
| 1,623,715 | 4/1927 | Berkowitz | 229/109 |
| 2,307,076 | 1/1943 | Ray . | |
| 2,749,018 | 6/1956 | Berke | 229/109 |
| 2,819,833 | 1/1958 | Sauer | 229/41 |
| 3,281,058 | 10/1966 | Buttery | 229/51 |
| 3,462,065 | 8/1969 | Asman | 229/109 |
| 4,019,675 | 4/1977 | Andersson et al. | 229/31 |
| 4,312,451 | 1/1982 | Forbes, Jr. | 206/628 |
| 4,718,596 | 1/1988 | Müller et al. | 229/109 |
| 4,765,534 | 8/1988 | Zion et al. | 229/109 |
| 4,901,911 | 2/1990 | Drexhage | 229/114 |
| 4,919,326 | 4/1990 | Deiger | 229/109 |
| 4,930,639 | 6/1990 | Rigby | 206/621 |
| 4,951,868 | 8/1990 | Mode | 229/112 |
| 5,031,824 | 7/1991 | Itey | 229/110 |

FOREIGN PATENT DOCUMENTS

| | | | |
|---|---|---|---|
| 158551 | 8/1954 | Australia | 229/110 |
| 2116150 | 9/1980 | United Kingdom | 229/109 |

*Primary Examiner*—Gary E. Elkins

*Attorney, Agent, or Firm*—Hamilton, Brook, Smith & Reynolds

[57] ABSTRACT

A multi-sided container for storing and heating food prepared from a blank of paperboard includes a bottom panel and upstanding end, corner and side walls. A first set of angular panels are connected to the corner walls and the base panel. The first angular panels overlap and are bonded to the base panel. A second set of angular panels are connected to the first angular panels and to the end walls. The second angular panels overlap and are bonded to the end walls. Vertical flange extensions extending from the corner walls and the second angular panels overlap and are bonded together with the raw edges facing away from the container.

35 Claims, 6 Drawing Sheets

MULTI-SIDED CONTAINER

BACKGROUND

Disposable paperboard containers are commonly used to package frozen food as a low cost alternative to plastic or aluminum containers. Paperboard containers known as ovenable containers can be also used to heat the food contained within by placing the container directly in a microwave or conventional oven. The ovenable container can then be used as a dish with the heated contents being eaten or served directly from the ovenable container.

Generally, ovenable containers are constructed from a paperboard blank formed of paperboard material that is coated on at least one side with a material that thermally stabilizes and waterproofs the paperboard material. The coating also allows the container to be heat sealed together. Typically, the paperboard blank is folded into a container having a liquid tight tray and a removable lid. The removable lid enables one to eat the contents of the container directly from the tray after heating.

SUMMARY OF THE INVENTION

Ovenable paperboard containers are generally rectangular. As a result, the consumer, when eating from the container has the feeling that he or she is eating from a box rather than from a dish.

Accordingly, there is a need for a low-cost disposable ovenable container for storing and heating food which can be heated in both a microwave and a conventional oven as well as having the appearance of a dish so that the consumer does not feel that he or she is eating from a box.

The present invention provides a container for storing and heating food. The container includes a number N of first angular panels foldably connected to a base panel at corners of the base panel. The first angular panels are folded to overlap the base panel. Foldably connected to respective first angular panels are a number N of upstanding corner walls which are folded upwardly. Upstanding end walls comprising a front and rear wall are also foldably connected to the base panel and folded upwardly. Foldably connected to respective end walls and respective first angular panels are a number N of second angular panels which are folded to overlap the end walls. A number N of first vertical flange extensions are foldably connected to respective corner walls. A number N of second vertical flange extensions are foldably connected to respective second angular panels and matching first vertical flange extensions. Each first and second matching vertical flange extensions are overlappingly bonded together such that the raw edges of all first and second vertical flange extensions are facing away from the container.

In preferred embodiments, the number N is an integer of at least four. A portion of each corner wall is contiguous with the base panel while a portion of each first vertical flange extension is contiguous with a respective first angular panel. Additionally, the first and second angular panels are triangular panels which are respectively bonded to the base panel and the end panels. The interior of the container is coated with a heat sealable waterproof coating which renders the container liquid tight and thermally stable in addition to permitting the container to be bonded together with heat and pressure.

Side walls are foldably connected to the base panel with each side wall being foldably connected between two corner walls. The combination of the side walls, corner walls, end walls and base panel results in an eight sided container resembling a bowl. A number of horizontal flange extensions are foldably connected to the upper edges of the corner walls, side walls and front wall and are adapted to lie in a plane substantially parallel to the plane of the base panel. A lid panel foldably connected to the rear wall is bonded to the horizontal flange extensions when the container is closed. A front closure flap foldably connected to the leading edge of the lid panel overlaps and is bonded to the front wall.

The container is opened by pulling and detaching the front closure flap from the front wall, then lifting the lid upwards to detach the lid from the horizontal flange extensions. Once the container is opened, the contents of the container can be consumed directly from the container.

Optionally, a series of score marks in the front wall closure flap enable the lid to be easily released from the front wall. Additionally, score marks can be made along the interior of the lid panel to allow the lid to be easily detached from the horizontal flange extensions.

The present invention provides a low cost disposable ovenable container for storing food as well as heating food in a microwave oven or a conventional oven. The carton of the present invention has a bowl shaped appearance and therefore, the consumer does not have the impression of eating from a box. Furthermore, the unique shape of the container is useful in helping consumers identify the contents of the container or the food producer by recognizing the shape of the container.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principals of the invention.

DETAILED DESCRIPTION OF THE PREFERRED EMBODIMENTS

Figure 1:
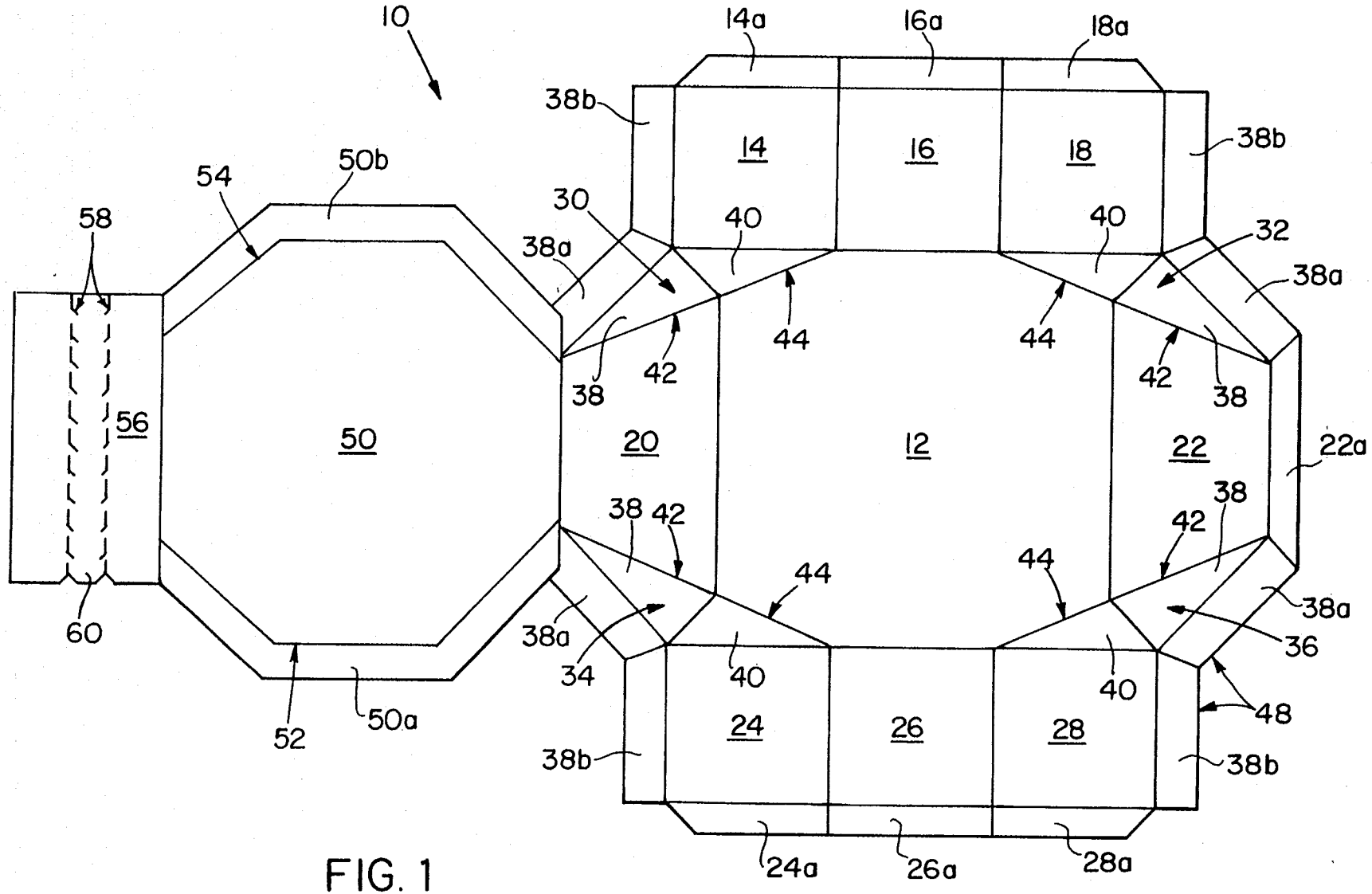
FIG. 1 is a plan view of a blank for constructing the container of the present invention.
Figure 2:
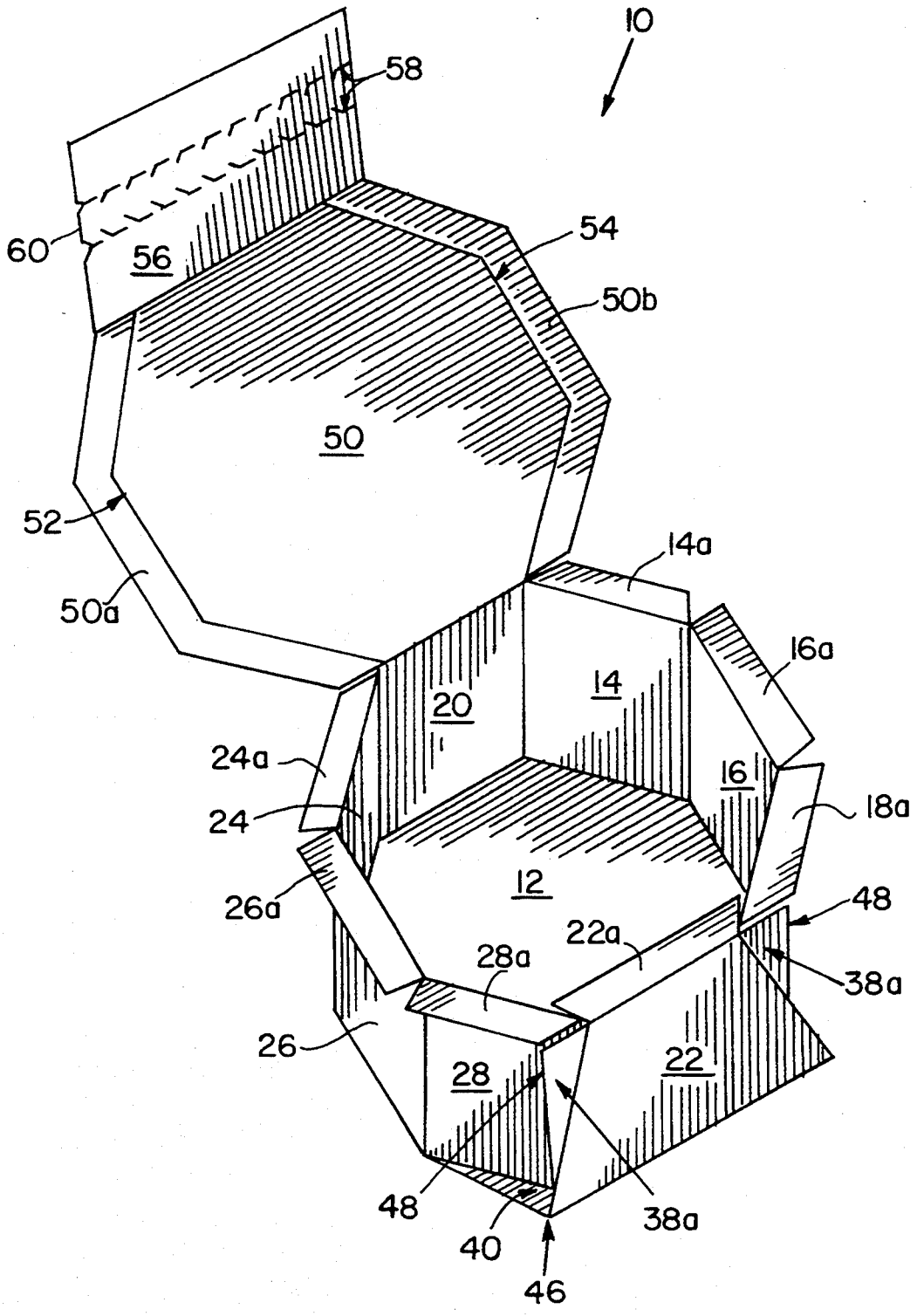
FIG. 2 is a perspective view of a container made from the blank of FIG. 1 prior to sealing the lid.
Figure 3:
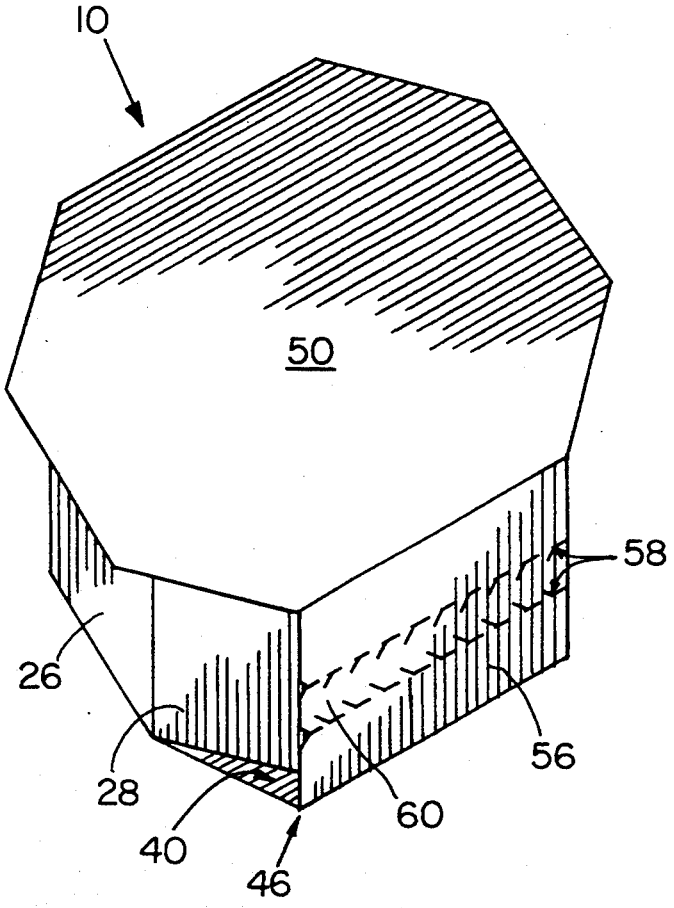
FIG. 3 is a perspective view of a sealed container made from the blank of FIG. 1.

In FIGS. 1, 2 and 3, container 10 is constructed from paperboard and has an eight-sided base panel 12 having eight upstanding walls. The walls include a front end wall 22, a rear end wall 20, two side walls 16 and 26 and four corner walls 14, 18, 24 and 28.

Four pairs 30, 32, 34 and 36 of foldable first and second triangular panels 40, 38 respectively are provided. The first triangular panels 40 are foldably connected to corner walls 14, 18, 24 and 28 as well as to the base panel 12 at the corners of base panel 12. An edge 44 lies along each corner of base panel 12. Each first triangular panel 40 is adapted to fold over edge 44 to overlap and be bonded to a portion of base panel 12. Each first triangular panel 40 is also foldably connected to a corner wall 14, 18, 24 or 28. Each second triangular panel 38 is foldably connected to an end wall 20 or 22 as well as a first triangular panel 40 and is adapted to fold over a side edge 42 to overlap and be bonded to a portion of a respective end wall 20 or 22.

In the preferred embodiment, the first and second triangular panels 40 and 38 are heat sealed respectively to base panel 12 and end walls 20 or 22. A coating of heat sealable material on the interior surfaces of the container 10 allows container 10 to be bonded together by heat and pressure. The heat sealable coating also makes container 10 liquid tight as well as thermally stable, thereby, allowing container 10 to be used either in a microwave or a conventional oven. In the preferred embodiment, the heat sealable coating is a waterbase coating but alternatively, can be a heat sealable thermoplastic material, such as polyester or polyethylene. Alternatively, glue can be used to bond the panels together. Additionally, container 10 is still functional if triangular panels 40 and 38 are not bonded to base panel 12 and end walls 20 and 22.

Extending from and foldably connected to each corner panel 14, 18, 24 and 28 is a first vertical flange extension **38*b*. Extending from and foldably connected to each second triangular panel 38 is a second vertical flange extension 38*a* which is also foldably connected to a matching first vertical flange extension 38*b*. The matching vertical flange extensions 38*a* and 38*b* are overlapped and heat sealed or glued together with the raw edges 48 of the vertical flange extensions 38*a* and 38*b* facing away from the container 10. In this manner, corner structures 46 are formed which extend from corner walls 14, 18, 24 and 28. As a result, container 10** has an interior with no exposed raw edges. Raw edges within the interior of a paperboard container are undesirable because moisture can be absorbed by raw paperboard edges, thereby weakening the container.

Horizontal flange extensions **14*a*, 16*a*, 18*a*, 24*a*, 26*a*, 28*a* and 22*a* extend from the upper portions of walls 14, 16, 18, 22, 24, 26 and 28 and are folded to be parallel with the base panel 12. An eight-sided lid 50 is foldably attached to the rear wall 20. The edges 50*a* and 50*b* of the lid 50 are heat sealed or glued to the horizontal flange extensions 14*a*, 16*a*, 18*a*, 24*a*, 26*a*, 28*a* and 22*a*. The front flap 56 of the lid 50 is folded and heat sealed or glued to the front panel 22 of the container 10**.

To open container 10, the front flap 56 is pulled from front wall 22 and lid 50 is lifted from horizontal flange extensions **14*a*, 16*a*, 18*a*, 24*a*, 26*a*, 28*a* and 22*a* such that the bonds between the front flap 56 and the front wall 22 are broken as well as the bonds between the lid 50 and the horizontal flange extensions 14*a*, 16*a*, 18*a*, 24*a*, 26*a*, 28*a* and 22*a*. Optionally, the interior of the lid 50 can have score marks 52 and 54 which enable lid 50 to be delaminated for easy opening. Additionally, the front flap 56 can have score marks 58 and pull tab 60 for releasing the front flap 56 from the front panel 22**.

Container 10 offers a paperboard container having a shape resembling a bowl and is capable of having uninterrupted graphics extending across two corner walls and a side wall. Food in various states (hydrated, dehydrated or frozen) can be stored in container 10. In addition, the food stored in container 10 can be contained within a pouch.

Figure 4:
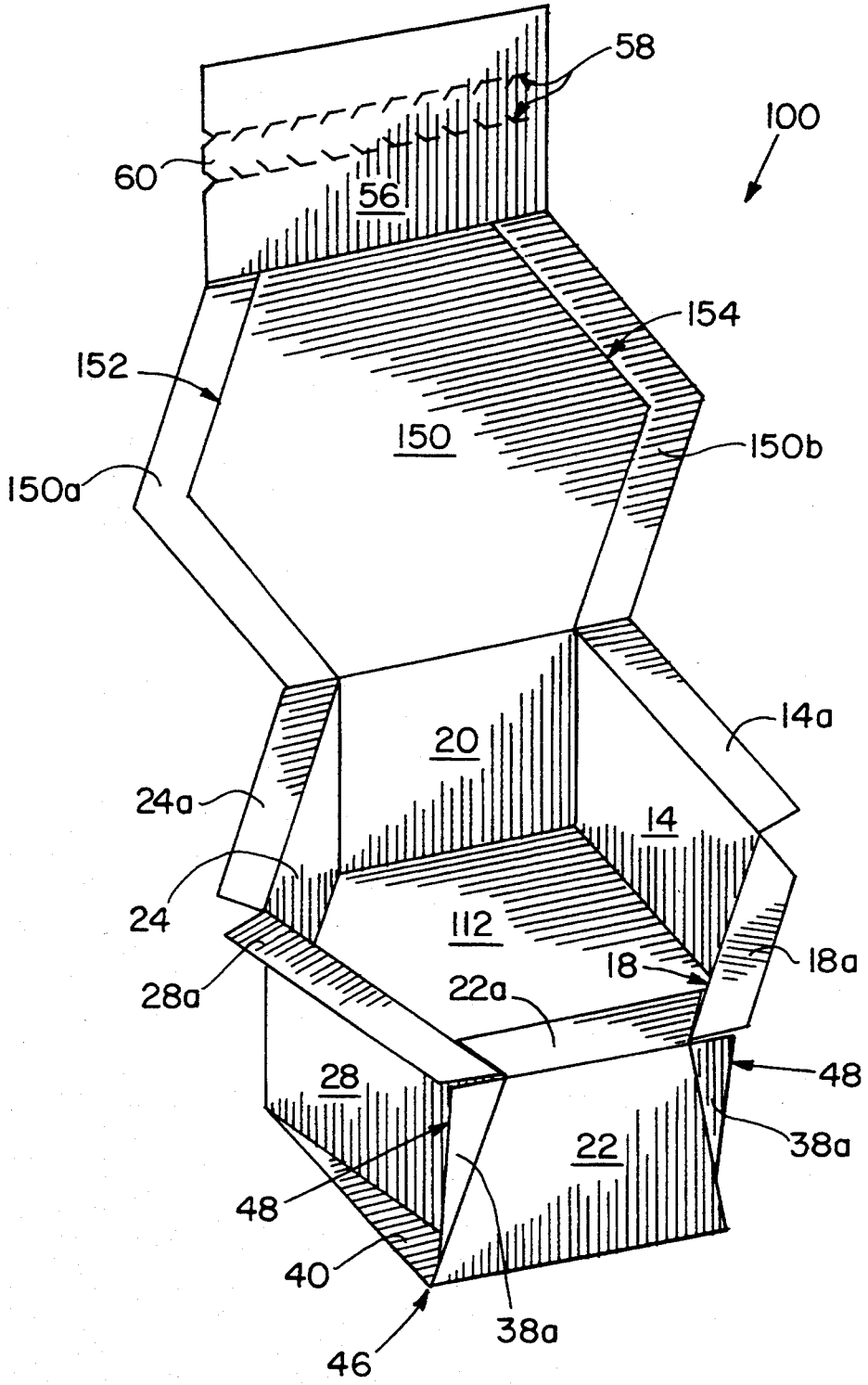
FIG. 4 is a perspective view of a preferred embodiment of the present invention container.

FIG. 4 depicts another preferred embodiment of the present invention for storing and heating food. Container 100 is similar to container 10 except that container 100 has six sides instead of eight sides. Container 100 does not have side walls, so that the corner walls 14 and 18 are foldably connected to each other on one side of container 100 while corner walls 24 and 28 are foldably connected to each other on the other side. Additionally, both base panel 112 and lid 150 are six sided. Edges **150*a*, 150*b* and score marks 152, 154 are adapted to the six sided configuration of lid 150 and are comparable to edges 50*a*, 50*b* and score marks 52, 54 of carton 10**.

Figure 5:
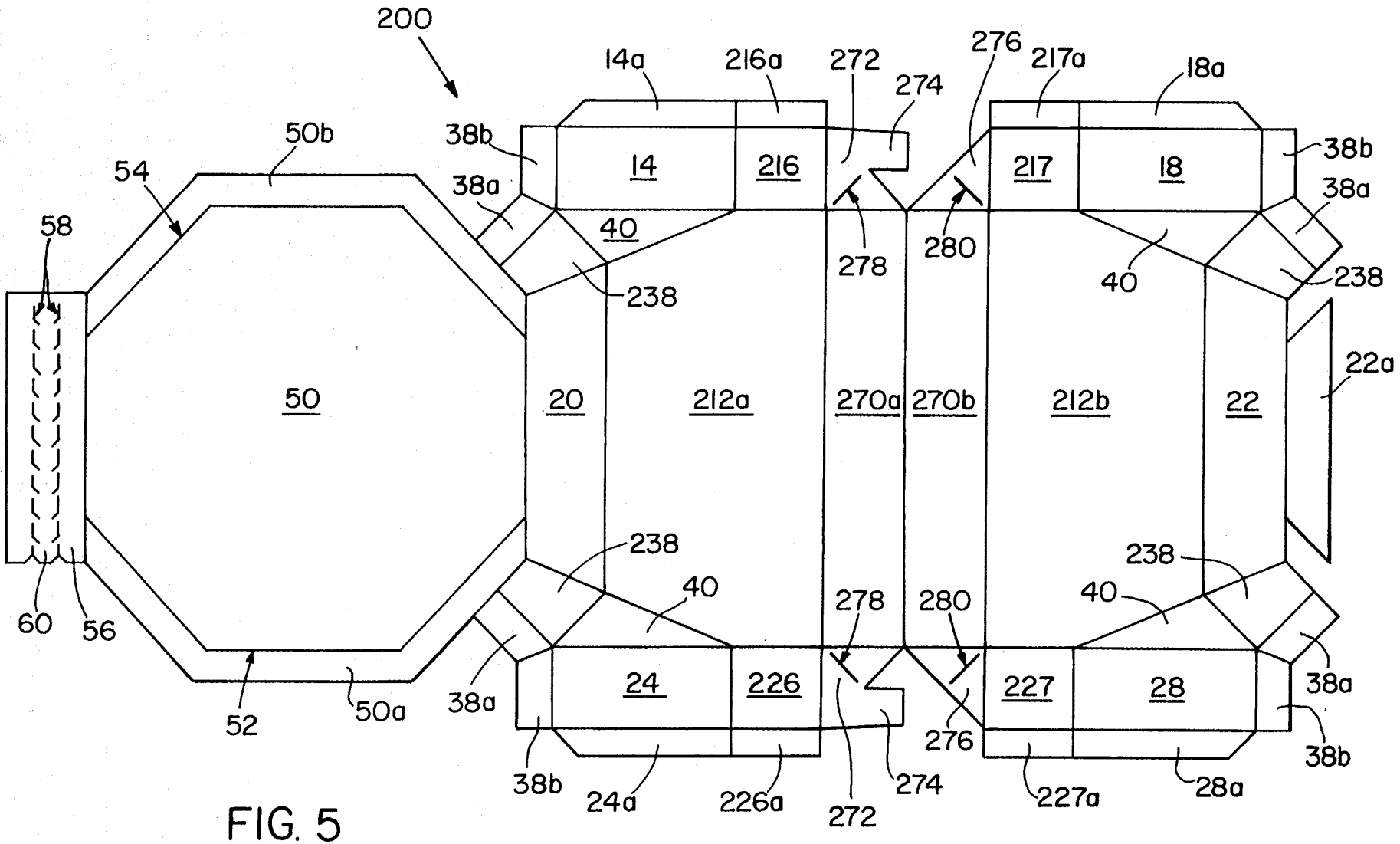
FIG. 5 is a plan view of a blank for constructing a container having a dividing wall.
Figure 6:
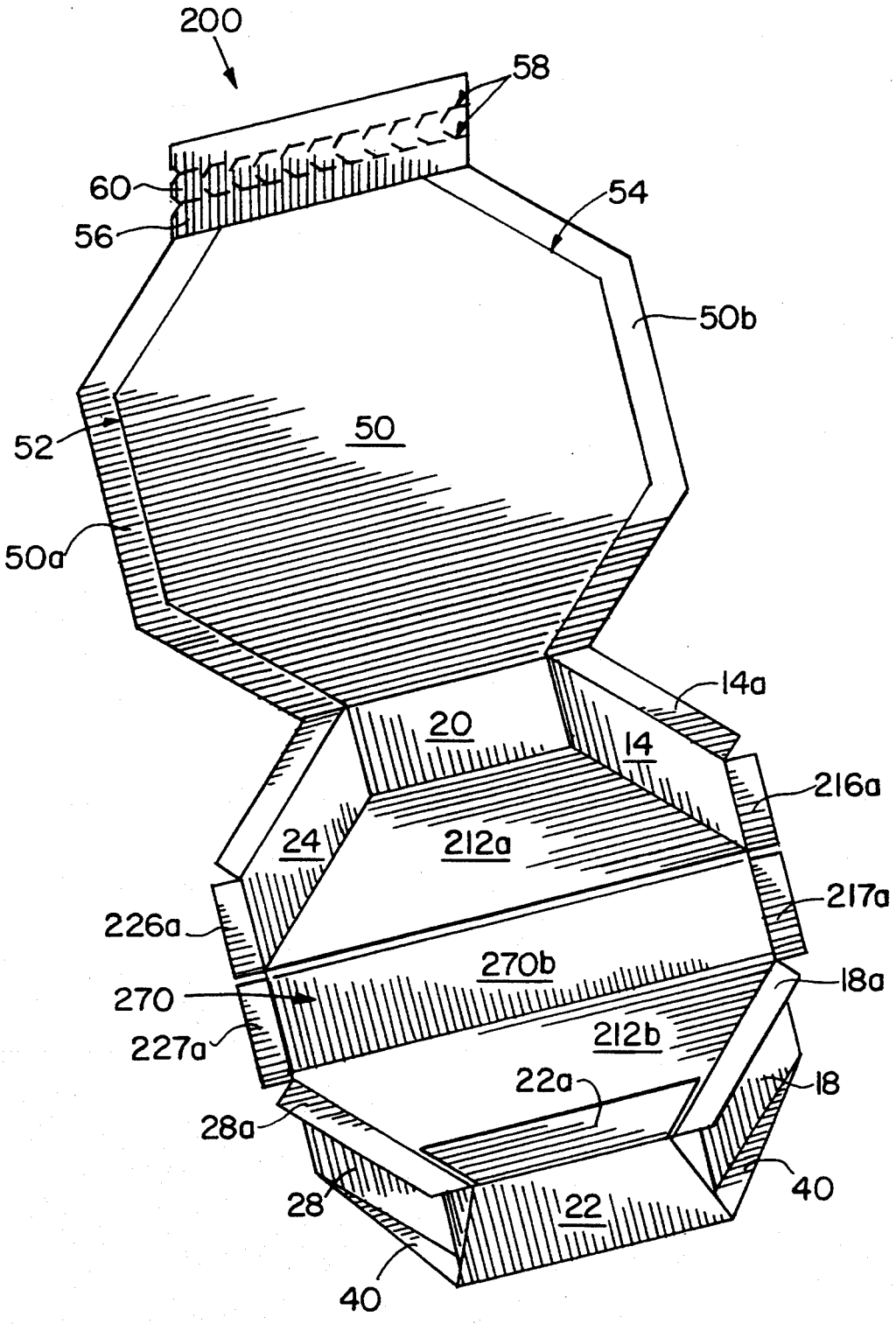
FIG. 6 is a perspective view of the container made from the blank of FIG. 5.

FIGS. 5 and 6 depict another preferred embodiment of the present invention in which container 200 is similar to container 10 except that container 200 is divided into two compartments by a dividing wall 270 formed from dividing wall panels **270*a* and 270*b*. The dividing wall 270 can be used to separate food contained within container 200. Dividing wall 270 is formed by folding dividing wall panels 270*a* and 270*b* upwards and bonding them together. Dividing wall panels 270*a* and 270*b* are foldably connected together and to base panels 212*a* and 212*b* respectively. Foldably attached to the ends of dividing wall panels 270*a* and 270*b* are support panels 272 and 276 respectively. Support panels 272 and 276 are also foldably attached to side panels 216/226 and 217/227 respectively. Support panels 272 and 276 are bonded together and folded across crease lines 278 and 280 so that tabs 274 can be bonded to side walls 217 or 227. In such a folded position, support panel 272 is folded onto itself and bonded together. Support panels 272 and 276 secure side walls 216 and 226 to side walls 217 and 227 respectively. Additionally, support panels 272 and 276 secure dividing wall 270** to the side walls.

Angular panels 238 perform similar function as triangular panels 38 (FIG. 1) except that angular panels 238 are truncated triangles because end walls 20 and 22 do not have sufficient height to allow for full triangular panels. However, if the height of end walls 20 and 22 were increased, angular panels 238 can be triangular in shape.

In the preferred embodiment, containers 10, 100 and 200 are constructed from paperboard. Additionally, containers 10, 100 and 200 have a lid 50 or 150 foldably attached to rear wall 20 and a front flap 56. However, alternatively, containers 10, 100 and 200 can be constructed from other suitable materials and do not require a front flap 56.

When a front flap 56 is omitted, lids 50 or 150 are bonded only to the horizontal flange extensions. In order to open a container having a lid with no front flap 56, the lid 50 or 150 is grasped and lifted upwards. Additionally, lids 50 or 150 do not have to be foldably attached to rear wall 20. In such a case, a horizontal flange extension foldably connected to the rear wall 20 is required. Furthermore, lids 50 and 150 can be omitted from containers 10, 100 and 200. A container which does not have a lid can be wrapped in a packaging material such as a plastic wrap in order to seal the contents within the container.

Equivalents

While this invention has been particularly shown and described with references to preferred embodiments thereof, it will be understood by those skilled in the art that various changes in form and details may be made therein without departing from the spirit and scope of the invention as defined by the appended claims. For example, panels shown and described to be directly connected to each another can be indirectly coupled together.

We claim:

1. A container for storing and heating food comprising:

a base panel having N corners where N is an integer of at least three;

N first angular panels, each first angular panel foldably connected to the base panel at a respective corner of the base panel, each first angular panel overlapping the base panel;

N upstanding corner walls, each corner wall foldably connected to a respective first angular panel;

upstanding end walls foldably connected to the base panel comprising a front wall and a rear wall;

N second angular panels, each second angular panel foldably connected to a respective end wall and a respective first angular panel, each second angular panel overlapping a respective end wall;

N first vertical flange extensions, each first vertical flange extension foldably connected to a respective corner wall and having a raw edge; and N second vertical flange extensions, each second vertical flange extension foldably connected to a respective second angular panel and a respective first vertical flange extension, each second vertical flange extension having a raw edge, each first and second vertical flange extension being overlappingly bonded together such that the raw edges of all of the first and second vertical flange extensions are facing away from the container.

2. The container of claim 1 in which N is four.

3. The container of claim 1 in which a portion of each corner wall is contiguous with the base panel.

4. The container of claim 1 in which a portion of each first vertical flange extension is contiguous with a respective first angular panel.

5. The container of claim 1 in which the first angular panels are bonded to the base panel and the second angular panels are bonded to respective end walls.

6. The container of claim 5 further comprising:

horizontal flange extensions foldably connected to respective upper edges of the front wall and the corner walls, the horizontal flange extensions being adapted to lie in a plane substantially parallel to the base panel; and a lid panel bonded to the horizontal flange extensions when the container is closed.

7. The container of claim 6 in which the lid panel has a leading edge and is foldably connected to the rear wall.

8. The container of claim 7 further comprising a closure flap foldably connected to the leading edge of the lid panel and adapted to be overlappingly bonded to the front wall.

9. The container of claim 8 further comprising means in the closure flap for releasing the lid panel from the front wall.

10. The container of claim 6 further comprising means in the lid panel for detachably removing the lid panel from the horizontal flange extensions.

11. The container of claim 5 further comprising side walls foldably connected to the base panel and foldably connected between two of the corner walls, each sidewall being between two different corner walls.

12. The container of claim 11 further comprising:

horizontal flange extensions foldably connected to respective upper edges of the side walls, corner walls and the front wall, the horizontal flange extensions being adapted to lie in a plane substantially parallel to the base panel; and a lid panel bonded to the horizontal flange extensions when the container is closed.

13. The container of claim 12 in which the lid panel has a leading edge and is foldably connected to the rear wall.

14. The container of claim 13 further comprising a closure flap foldably connected to the leading edge of the lid panel and adapted to be overlappingly bonded to the front wall.

15. The container of claim 14 further comprising means in the closure flap for releasing the lid panel from the front wall.

16. The container of claim 13 further comprising means in the lid panel for detachably removing the lid panel from the horizontal flange extensions.

17. The container of claim 1 in which the first and second angular panels are triangular.

18. A container for storing and heating food comprising:

a base panel having N corners where N is an integer of at least three;

N first angular panels, each first angular panel foldably connected to the base panel at respective corners of the base panel, each first angular panel overlapping and being bonded to the base panel;

N upstanding corner walls, each corner wall foldably connected to a respective first angular panel;

upstanding end walls foldably connected to the base panel comprising a front wall and a rear wall;

N second angular panels, each second angular panel foldably connected to respective end walls and respective first angular panels, each second angular panel overlapping and being bonded to a respective end wall;

N first vertical flange extensions, each first vertical flange extension foldably connected to a respective corner wall and having a raw edge;

N second vertical flange extensions, each second vertical flange extension foldably connected to a respective second angular panel and a respective first vertical flange extension, each second vertical flange extension having a raw edge, each first and second vertical flange extension being overlappingly bonded together such that the raw edges of all of the first and second vertical flange extensions are facing away from the container;

horizontal flange extensions foldably connected to respective upper edges of the front wall and corner walls, the horizontal flange extensions being adapted to lie in a plane substantially parallel to the base panel; and a lid panel foldably connected to the rear wall, the lid panel having a leading edge and being bonded to the horizontal flange extensions when the container is closed.

19. The container of claim 18 in which N is at least four.

20. The container of claim 18 in which a portion of each corner wall is contiguous with the base panel.

21. The container of claim 18 in which a portion of each first vertical flange extension is contiguous with a respective first angular panel.

22. The container of claim 18 further comprising a closure flap foldably connected to the leading edge of the lid panel and adapted to be overlappingly bonded to the front wall.

23. The container of claim 22 further comprising means in the closure flap for releasing the lid from the front wall.

24. The container of claim 18 further comprising means in the lid panel for detachably removing the lid from the horizontal flange extensions.

25. The container of claim 18 further comprising:

side walls foldably connected to the base panel and foldably connected between two of the corner walls, each side wall having a horizontal flange extension foldably connected to an upper edge of each side wall and adapted to lie in a plane substantially parallel to the base panel for bonding to the lid panel, each side wall being between two different corner walls.

26. The container of claim 25 further comprising a closure flap foldably connected to the leading edge of the lid panel and adapted to be overlappingly bonded to the front wall.

27. The container of claim 26 further comprising means in the closure flap for releasing the lid from the front wall.

28. The container of claim 25 further comprising means in the lid panel for detachably removing the lid from the horizontal flange extensions.

29. The container of claim 18 in which the first and second angular panels are triangular.

30. A method of forming a container for storing and heating food from a single blank comprising the steps of:

a) folding N first angular panels over respective corners of a base panel such that the first angular panels overlap the base panel;

b) upwardly folding N corner walls, from respective first angular panels;

c) upwardly folding end walls, the end walls comprising a front wall and a rear wall;

d) folding N second angular panels over respective end walls such that each second angular panel overlaps a respective end wall; and e) bonding N first vertical flange extensions to N matching second vertical flange extensions, each first vertical flange extension having a raw edge and being foldably connected to a respective corner wall, each second vertical flange extension having a raw edge and being foldably connected to a respective second angular panel, each matching first and second vertical flange extension being bonded together such that the raw edges of all of the first and second vertical flange extensions are facing away from the container.

31. The method of claim 30 in which N is four.

32. The method of claim 30 further comprising:

folding horizontal flange extensions foldably connected to respective upper edges of the front wall and the corner walls such that the horizontal flange extensions lie in a plane substantially parallel to the base panel; and bonding a lid panel to the horizontal flange extensions when the container is closed, the lid panel having a leading edge.

33. The method of claim 30 further comprising:

bonding each first angular panel to the base panel; and bonding each second angular panel to a respective end wall.

34. The method of claim 32 further comprising:

bonding a closure flap which is foldably attached to the leading edge of the lid panel to the front wall.

35. The method of claim 30 further comprising upwardly folding side walls which are foldably connected to the base panel and foldably connected between two of the corner walls, each sidewall being between two different corner walls.

* * * * *